US005358180A

United States Patent [19]

Prassas et al.

[11] Patent Number: 5,358,180

[45] Date of Patent: Oct. 25, 1994

[54] SELECTABLE SPRAY PATTERN LOW VOLUME SPRINKLER

[75] Inventors: Thomas N. Prassas, Glendale; Shannon Bard, Scottsdale, both of Ariz.; Allan L. Smith, Exeter, Calif.

[73] Assignee: Aquapore Moisture Systems, Inc., Phoenix, Ariz.

[21] Appl. No.: 43,479

[22] Filed: Apr. 6, 1993

[51] Int. Cl.[5] ..... B05B 3/00

[52] U.S. Cl. ..... 239/391; 239/393; 239/DIG. 1

[58] Field of Search ..... 239/288, 288.3, 288.5, 239/390, 393, DIG. 1

[56] References Cited

U.S. PATENT DOCUMENTS

| | | | |
|---|---|---|---|
| 630,468 | 8/1899 | Quayle | 239/393 X |
| 2,027,567 | 1/1936 | Webb | 239/390 |
| 2,190,639 | 2/1940 | Wittek | 239/390 |
| 2,711,925 | 6/1955 | King | 239/390 |
| 3,094,283 | 6/1963 | Balister | 239/393 |
| 3,903,234 | 8/1969 | Van Baak | 239/288.3 X |
| 4,805,838 | 2/1980 | Greenberg | 239/222.17 |

FOREIGN PATENT DOCUMENTS

| | | | |
|---|---|---|---|
| 577655 | 5/1946 | United Kingdom | 239/288.3 |

*Primary Examiner*—Andres Kashnikow
*Assistant Examiner*—Kevin Weldon
*Attorney, Agent, or Firm*—Marvin E. Jacobs

[57] ABSTRACT

Water from a low pressure irrigation system is conveyed through a tube and sprayed upward from an orifice. A collection of splash plate water deflectors rotates above the orifice on supports extending up from the tube. Different surface shapes on the splash plates create different spray patterns when they are rotated into the path of the water stream from the orifice. A flow rate valve is incorporated into the tube to regulate water flow.

10 Claims, 2 Drawing Sheets

FIG. 2
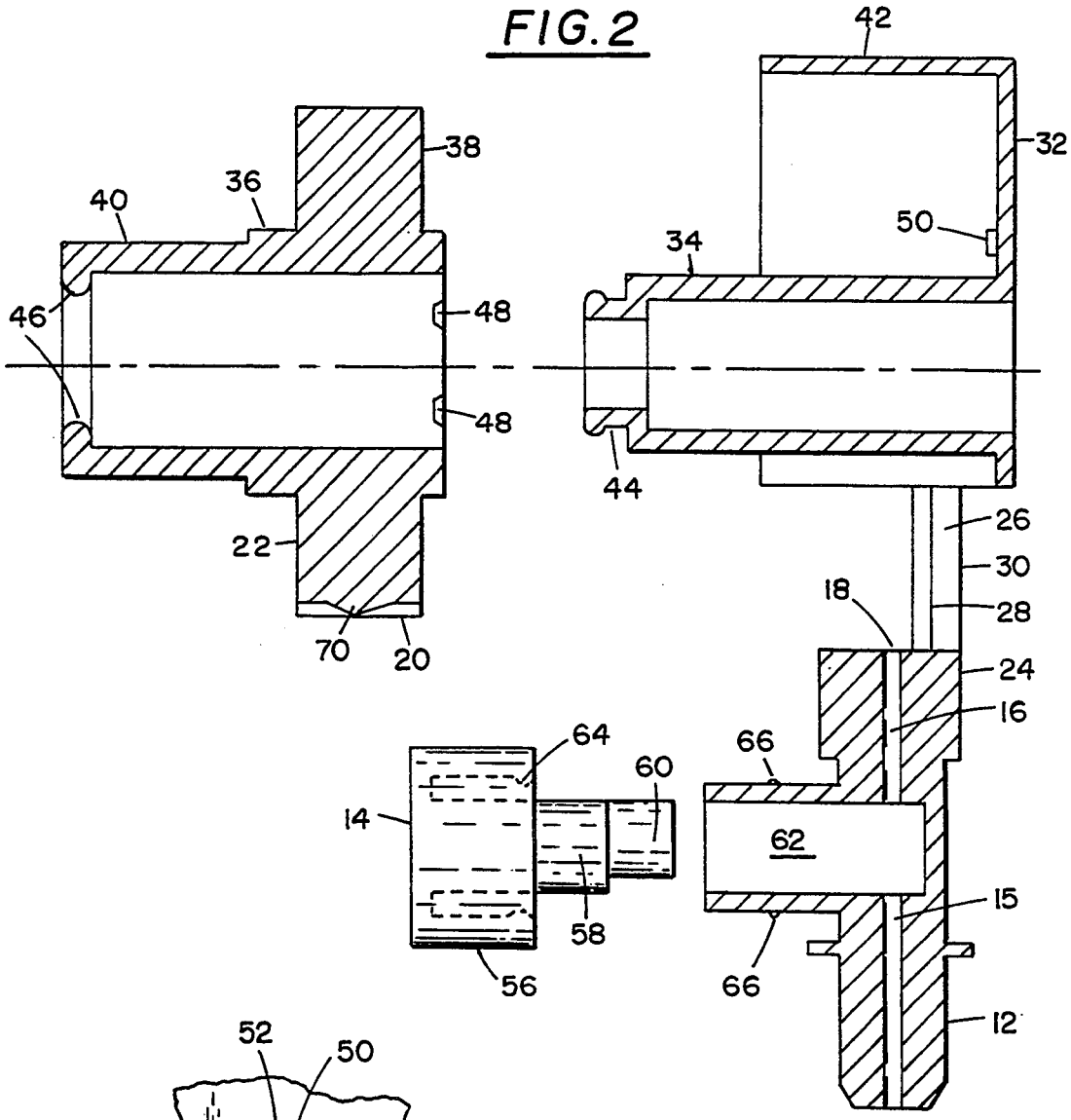
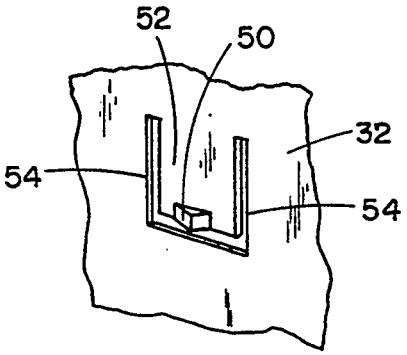
FIG. 3

SELECTABLE SPRAY PATTERN LOW VOLUME SPRINKLER

TECHNICAL FIELD

This invention pertains to irrigation water sprinklers, especially sprinklers adapted to work in conjunction with the more efficient low volume irrigation systems such as are used to feed drip systems, porous hose systems, and other point sources.

BACKGROUND OF THE INVENTION

The prior art recognizes the advantages of spray type low volume sprinklers, sometimes called microsprayers or microsprinklers, compared to larger rotary, impact, or conventional pop-up sprinklers and small drip emitters. Low pressure systems that operate in the 20 to 30 psi range are more energy efficient since they deliver smaller amounts of water to just the locations where it is needed. This is better than pumping high pressure large volumes of water wastefully over large areas. The low application rates of low pressure systems provide better soil penetration and less runoff. The controlled water placement allows water to be delivered directly to just the plant that needs it, not broadcast over wide areas. Hence, trunks, foliage, and traffic areas remain dry. This saves on water as well. The lower operating pressures and flow rates saves money on pumping energy. Erosion is reduced with microsprinklers. They spread water evenly over the root zone of a plant, simulating natural rainfall. By contrast, a drip emitter soaks one spot for a longer time which tends to leach the soil and decrease soil aeration.

Prior art spray type microsprinklers generally produce one spray pattern each and thus must be available in a variety of different spray pattern types so as to optimally spray water exactly where desired. Typically, a low volume irrigation system is custom planned in advance to serve a particular collection of plants, with the correct spray head chosen for each location in the garden. One suffers the inconvenience, therefore, of having to select new spray heads if the garden is changed or if a mistake is made. The user inevitably ends up paying for extra unused sprinklers and parts. The present invention overcomes this problem by providing a novel multipurpose spray head that allows a plurality of desired spray patterns to be generated by a single microsprayer.

STATEMENT OF THE INVENTION

Briefly, this invention utilizes a manually rotatable rotor adapted to carry a plurality of differently shaped splash plates into position in front of a water emitting orifice. A jet of water from the orifice is deflected sideways by the selected splash plate into a pattern that is determined by the surface configuration of the plate. Spray patterns can be generated that range from a narrow, almost unidirectional, stream only a few degrees wide, to a full 360 degree omnidirectional stream. In addition, a flow control valve is incorporated into the sprinkler to allow adjustment of the size of the spray pattern. The use of a single orifice is advantageous because the larger nozzle size is easier to keep clean and less likely to clog. Prior art sprayers that use a multiplicity of tiny water emitting holes are prone to blockage by dirt or dissolved solids in the water which disrupts the spray pattern. Many other advantages will become apparent upon consideration of the detailed description below and the drawing referenced thereby.

BRIEF DESCRIPTION OF THE DRAWINGS

FIG. 2 is a partly sectioned side view of the sprinkler with the splash plate rotor and the flow rate valve withdrawn from their operational positions to enhance clarity.

FIG. 3 is a detail of a detent spring operable to positionally locate the splash plate rotor.

DETAILED DESCRIPTION OF THE INVENTION

Figure 1:
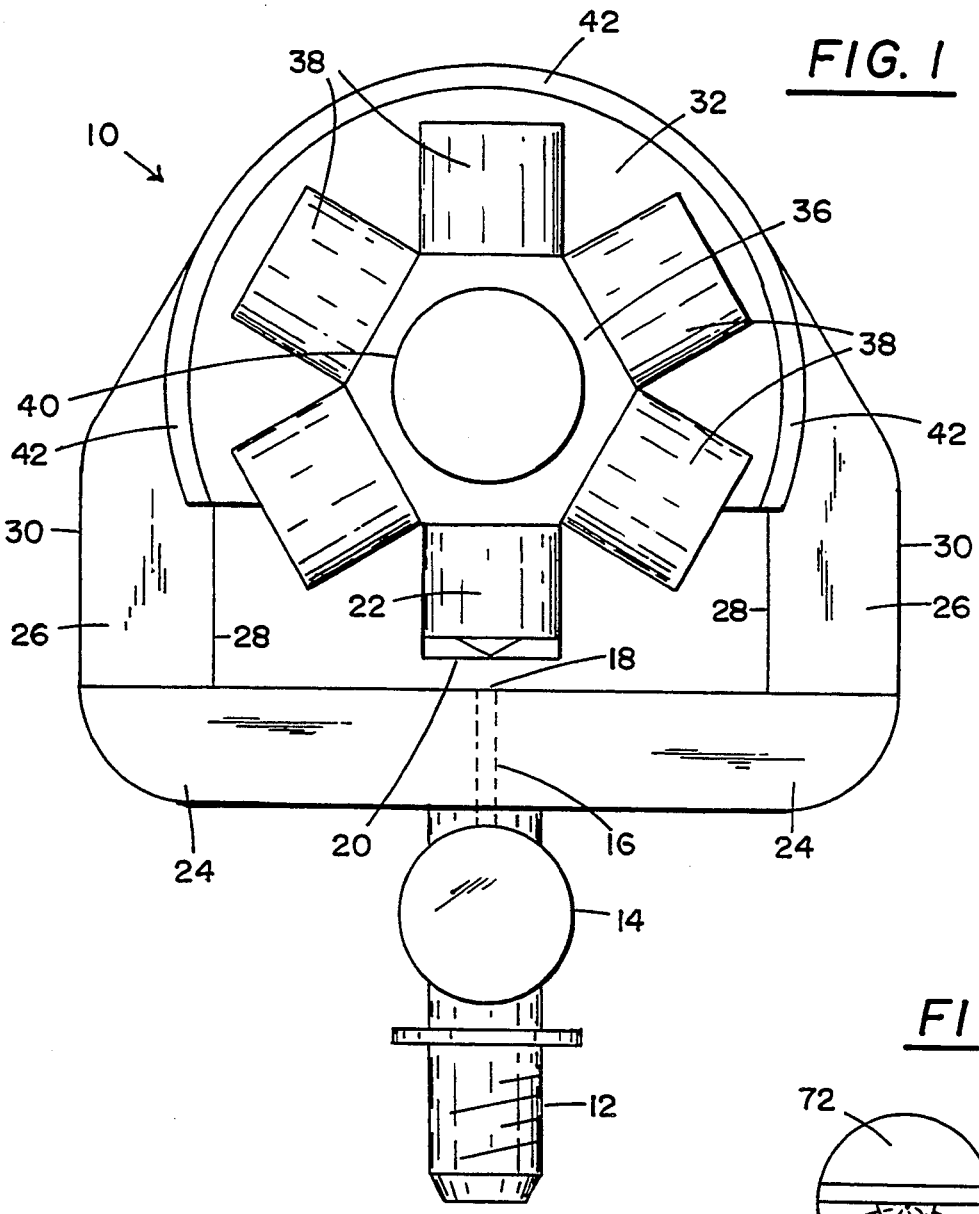
FIG. 1 is an elevational front view of the microsprinkler of this invention.

The microsprinkler 10 of the present invention is shown in FIG. 1. A hollow nipple 12 is conventionally sized and threaded to sealingly screw into a riser tube from a standard low pressure drip irrigation system or the like. Water from the irrigation system travels up inside nipple 12, through a flow rate control valve 14, and through a passage 16, to emerge vertically from an orifice 18. The stream of water is deflected sideways by the shaped surface 20 of splash plate 22.

A cross support 24 carries, at the ends, a pair of wedge shaped vertical supports 26. Vertical supports 26 are wedge shaped in cross section, having sharp interior facing edges 28 and thicker exterior portions 30. This wedge shape offers the least obstruction to water sprayed horizontally from splash plate 22. A rotor support member 32 extends between vertical supports 26. As most easily seen in FIG. 2, a tubular axle 34 extends out horizontally from member 32. A rotor 36 revolves around axle 34 and carries at its perimeter a plurality of splash plates 38. Rotor 36 includes a projecting knob 40 to allow the desired splash plate to be rotated into position above orifice 18. Since rotor 36 rotates about a horizontal axis, the splash plates 38 that are not in use are disposed up and out of the way so that they do not interfere with the spray pattern of the in use splash plate 22.

Rotor support member 32 has an integral shield or hood 42 that arches over rotor 36 and protects the rotor and splash plates. All of the described parts may be molded from a suitable plastic such as acetal copolymer or polypropylene.

Referring to FIG. 2, axle 34 has an annular groove 44 at the end. When rotor 36 is mounted about axle 34, with the splash plates centered above orifice 18, an internal lip 46 snaps into groove 44 to retain rotor 36 in the proper position. To insure that rotor 36 is not rotated out of position by the force of the water stream from orifice 18, rotor 36 includes a number of indentations 48 at the rear. Support member 32 has a springable protuberance 50 that enters indentations 48 when the splash plates are aligned with the orifice. The detail in FIG. 3 shows how protuberance 50 is molded at the end of a tab 52 formed by a C-shaped slot 54. Tab 52 provides a simple low cost spring.

Flow rate valve 14 comprises a finger knob 56 with a central cylindrical member 58 having a spiral surface 60 at the end. Member 58 fits within cylindrical space 62, retained in place by annular lip 64 and bumps 66. Rotation of knob 56 moves surface 60 past passages 16 and 15 to vary the volume of water flowing therebetween.

This additional flexibility also contributes to controlling the size and extent of the spray pattern from the splash plates.

Figure 4:
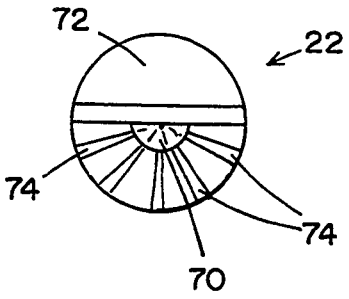
FIGS. 4 and 5 show exemplary splash plate shapes for deflecting water in 180 degree and 360 degree patterns respectively.
Figure 5:
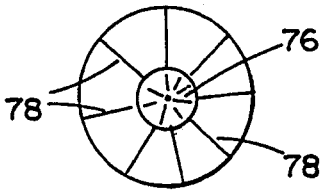

Any number of water deflecting splash plates may be disposed about the perimeter of rotor 36. Six are shown in the preferred embodiment. The orifice facing surface of the splash plates can be shaped in a wide variety of ways to generate different spray patterns. Two examples are shown in FIGS. 4 and 5. FIG. 4 shows a surface like surface 20 in FIGS. 1 and 2. Half of a small central cone 70 deflects water laterally. A raised area 72 extends over about half the surface, that is 180 degrees of the circle, so as to block deflection in that direction. The other half of the surface may have a plurality of grooves 74 to guide the streams of water into the desired half circle pattern. To sprinkle water in a full 360 degree pattern, a surface as in FIG. 5 may be used with a full central cone 76 and a full circle of guide grooves 78. A large variation in splash plate shapes is possible. Also, different rotor shapes and mountings may be used, different valves, and different support structures, all within the spirit and scope of the invention. Hence, limitation only by the appended claims and their equivalents is appropriate.

We claim:

1. A low volume water sprinkler, having a selectable spray pattern, comprising in combination:

a water receiving tubular member adapted to connect to an irrigation system and further adapted to convey water therethrough, said tubular member having an orifice therein operable to emit a stream of water therefrom;

support structure means on said tubular member extending into the region of said stream of water from said orifice;

an axle formed of synthetic resin being mounted at one end of the support structure and having an annular groove thereabout;

movable means on said support structure means, said movable means comprising a rotor adapted to rotate about said axle, said rotor also comprising synthetic resin and having an annular internal lip shaped to snap into said groove and retain said rotor;

a plurality of water deflecting splash plates mounted on said movable means so as to be selectably movable into the path of said stream of water and deflect said stream of water.

2. The apparatus of claim 1 in which said rotor and said splash plates are an integral, unitary molded resin structure.

3. The apparatus of claim 1 including a plurality of indentations on said rotor and a spring urged detent on said support structure means operable to enter the indentations when the splash plates are aligned with the stream of water so as to resist rotation of the rotor.

4. The apparatus of claim 1 in which said support structure means is wedge shaped in the portions in the path of the deflected water with the narrow edge facing the splash plate deflected water and the wider edge away from the deflected water so as to avoid obstructing the spray pattern.

5. The apparatus of claim 2 in which said splash plates have different fixed surface shapes so as to generate different patterns and directions of deflected water.

6. The apparatus of claim 1 including a single water flow rate controlling valve incorporated into said tubular member in order to regulate the flow of water therethrough and the force of the stream of water from said orifice.

7. The apparatus of claim 6 in which said water flow rate controlling valve comprises a cylindrical member with a spiral surface at one end adapted to rotate within a cylindrical cavity with said spiral surface projecting into said tubular member so as to variably block the flow of water therethrough.

8. The apparatus of claim 1 including a shield member on said support structure means adapted to partially encircle and protect said rotor and splash plates.

9. The apparatus of claim 2 in which said resin is flexible.

10. The apparatus of claim 9 in which the resin is selected from polypropylene or acetal copolymer.

* * * * *

UNITED STATES PATENT AND TRADEMARK OFFICE

CERTIFICATE OF CORRECTION

PATENT NO. : 5,358,180

DATED : October 25, 1994

INVENTOR(S) : Prassas, et al

It is certified that error appears in the above-indentified patent and that said Letters Patent is hereby corrected as shown below:

On the title page, item [73] Assignee: after "Ariz." add --; a part interest.--.

Signed and Sealed this

Fourteenth Day of February, 1995

*Attest:*

*Attesting Officer*

BRUCE LEHMAN

*Commissioner of Patents and Trademarks*